US009138855B2

(12) United States Patent
Kang et al.

(10) Patent No.: US 9,138,855 B2
(45) Date of Patent: Sep. 22, 2015

(54) MULTIFUNCTIONAL SUBSTRATE POLISHING AND BURNISHING DEVICE AND POLISHING AND BURNISHING METHOD THEREOF

(75) Inventors: Renke Kang, Liaoning (CN); Xianglong Zhu, Liaoning (CN); Zhigang Dong, Liaoning (CN); Guang Feng, Liaoning (CN); Dongming Guo, Liaoning (CN)

(73) Assignee: Dalian University of Technology School of Mechanical Engineering, Liaoning (TW)

( * ) Notice: Subject to any disclaimer, the term of this patent is extended or adjusted under 35 U.S.C. 154(b) by 24 days.

(21) Appl. No.: 14/124,398

(22) PCT Filed: Jan. 19, 2012

(86) PCT No.: PCT/CN2012/070627

§ 371 (c)(1),
(2), (4) Date: Dec. 6, 2013

(87) PCT Pub. No.: WO2013/107030

PCT Pub. Date: Jul. 25, 2013

(65) Prior Publication Data

US 2014/0106647 A1 Apr. 17, 2014

(51) Int. Cl.

| | |
|---|---|
| ***B24B 37/04*** | (2012.01) |
| ***B24B 37/10*** | (2012.01) |
| ***B24B 27/00*** | (2006.01) |
| ***B24B 7/22*** | (2006.01) |
| ***B24B 49/16*** | (2006.01) |

(52) U.S. Cl.

CPC ..... *B24B 27/0076* (2013.01); *B24B 7/228* (2013.01); *B24B 37/04* (2013.01); *B24B 37/10* (2013.01); *B24B 49/16* (2013.01)

(58) Field of Classification Search

CPC ..... B24B 37/04; B24B 37/07; B24B 37/10; B24B 37/105; B24B 37/30; B24B 27/0076

USPC ..... 451/41, 65, 66, 285, 287, 398

See application file for complete search history.

(56) References Cited

U.S. PATENT DOCUMENTS

| | | | | |
|---|---|---|---|---|
| 2005/0118938 | A1 * | 6/2005 | Mizomoto et al. | 451/65 |
| 2005/0173377 | A1 | 8/2005 | Pietsch et al. | |
| 2012/0202406 | A1 * | 8/2012 | Trojan et al. | 451/57 |

FOREIGN PATENT DOCUMENTS

| | | | |
|---|---|---|---|
| CN | 1652307 | A | 8/2005 |
| CN | 1833818 | A | 9/2006 |
| CN | 201371405 | Y | 12/2009 |
| CN | 102554760 | A | 7/2012 |
| DE | 200011 | A | 3/1983 |
| JP | 2001-25951 | A | 1/2001 |

* cited by examiner

*Primary Examiner* — Eileen Morgan

(74) *Attorney, Agent, or Firm* — Muncy, Geissler, Olds & Lowe, P.C.

(57) ABSTRACT

A substrate grinding and polishing device comprising separate grinding and polishing units for operating on a workpiece. The work piece is clamped to a rotating work table under the units and a track underneath the rotating work table allows for quick transfer from the grinding unit to the polishing unit or vice versa. This setup allows for easy transfer as well as quick adjustment between different modes of grinding and polishing.

9 Claims, 4 Drawing Sheets

MULTIFUNCTIONAL SUBSTRATE POLISHING AND BURNISHING DEVICE AND POLISHING AND BURNISHING METHOD THEREOF

FIELD OF THE INVENTION

The present invention involves a method of grinding and polishing flat and thinning of hard and brittle materials such as silicon wafers, sapphire substrates and glass substrates, which belongs to the flat substrate ultra-precision machining technical field. It could also be used in the grinding and polishing process of flat thin substrates such as ceramics, metal and composite materials.

DESCRIPTION OF RELATED ART

Ultra-precision surface processing and ultra-precision thinning processing of flat sheet-shaped substrates such as silicon, sapphire substrates, glass panels and ceramics, are usually processed by machining process such as grinding, lapping and polishing, which are achieved respectively by grinding tools, lapping tools and polishing tools. Grinding and lapping tools are used for the surface planarization processing of the substrate to make the substrate reach a predetermined thickness and to obtain a high-quality and high-flatness surface. Polishing tools are used for surface polishing of the substrate to remove the substrate grinding and lapping surface damage layer, where ultra-smooth surface substrates without damages are obtained. At present, in order to get lighter and thinner substrates, substrate thinning processing typically requires thinning thickness less than 30~100 μm. When the substrate is thinned to a predetermined thickness after grinding, the substrate is removed from the grinding machine, and is then clamped to the polishing machine for polishing. During the conversion process from grinding to polishing, the grinding stress on the substrate surface will cause deformation of the substrate, which makes the substrate get broken more easily in the conversion process and re-clamping process. In addition, using two machine tools to process grinding and polishing respectively will result in large equipment investment and low production efficiency. Currently, common substrate grinding and polishing machine tools are usually dedicated grinding equipment. As for disc-shaped wafers, ultra-precision silicon wafer grinding machine is mainly used for wafer planarization processing and thinning processing and plane polishing machine for surface polishing. As for square-sheet glass panels, dedicated plane lapping tools are mainly used for planarization and thinning processing and plane polishing tools for surface polishing. These existing grinding and polishing tools are usually not available for many other different requirements of a substrate.

At present, in order to get lighter and thinner substrates, substrate thinning processing typically requires thinning thickness less than 30~100 μm. When the substrate is thinned to a predetermined thickness after grinding, the substrate is removed from the grinding machine, and is then clamped to the polishing machine for polishing. During the conversion process from grinding to polishing, the grinding stress on the substrate surface will cause deformation of the substrate, which makes the substrate get broken more easily in the conversion process and re-clamping process. In addition, using two machine tools to process grinding and polishing respectively will result in large equipment investment and low production efficiency. Currently, common substrate grinding and polishing machine tools are usually dedicated grinding equipment. As for disc-shaped wafers, ultra-precision silicon wafer grinding machine is mainly used for wafer planarization processing and thinning processing and plane polishing machine for surface polishing. As for square-sheet glass panels, dedicated plane lapping tools are mainly used for planarization and thinning processing and plane polishing tools for surface polishing. These existing grinding and polishing tools are usually not available for many other different requirements of a substrate.

BRIEF SUMMARY OF THE INVENTION

The technical problem to be solved in the invention is to overcome of inadequacies of the conventional grinding and polishing machine. A multifunction substrate grinding and polishing device and its method for the substrate grinding and polishing are invented. Double-spindle structure is used in the substrate grinding and polishing device where grinding and polishing of substrates such as silicon wafer, glass panels, ceramics and sapphire substrate can be done. After grinding, without unloading the substrate, the substrate moves from the grinding station directly into the polishing station waiting for the polishing process of a substrate. Many processing methods could be achieved in the device such as axial plunge grinding and polishing, radial plunge grinding and polishing and back grinding and polishing of wafer with outer rim. The grinding spindle unit and polishing spindle counterweigh mutually via a traction rope, sharing a motor driven feed mechanism and cylinder feed mechanism. Fixed stroke grinding and force control grinding could be realized during the grinding or polishing process of the substrate.

The invention, involving grinding and polishing flat processing and thinning processing of hard and brittle materials such as silicon wafer, sapphire substrate and the glass substrate, belongs to ultra-precision machining technical field and provides a multifunction substrate grinding and polishing device and method for the substrate grinding and polishing, which could be used in the grinding and polishing process of flat substrate such as ceramics, metal and composite materials. The grinding and polishing of substrate are processed in three ways: axial plunge grinding and polishing, radial plunge grinding and polishing and back grinding and polishing of wafer with outer rim. Double-spindle structure consisting of grinding spindle unit and polishing spindle unit is used in the substrate grinding and polishing device where both substrate grinding and polishing can be done. The grinding spindle unit and polishing spindle counterweigh mutually via a traction rope. Since the grinding machine and polishing machine are integrated in the substrate grinding and polishing device, the grinding process and polishing process could be finished in order with just one clamping of the substrate, which improves the precision of the substrate grinding and polishing and the automation of grinding and polishing process, reduces fragmentation and improves production efficiency.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
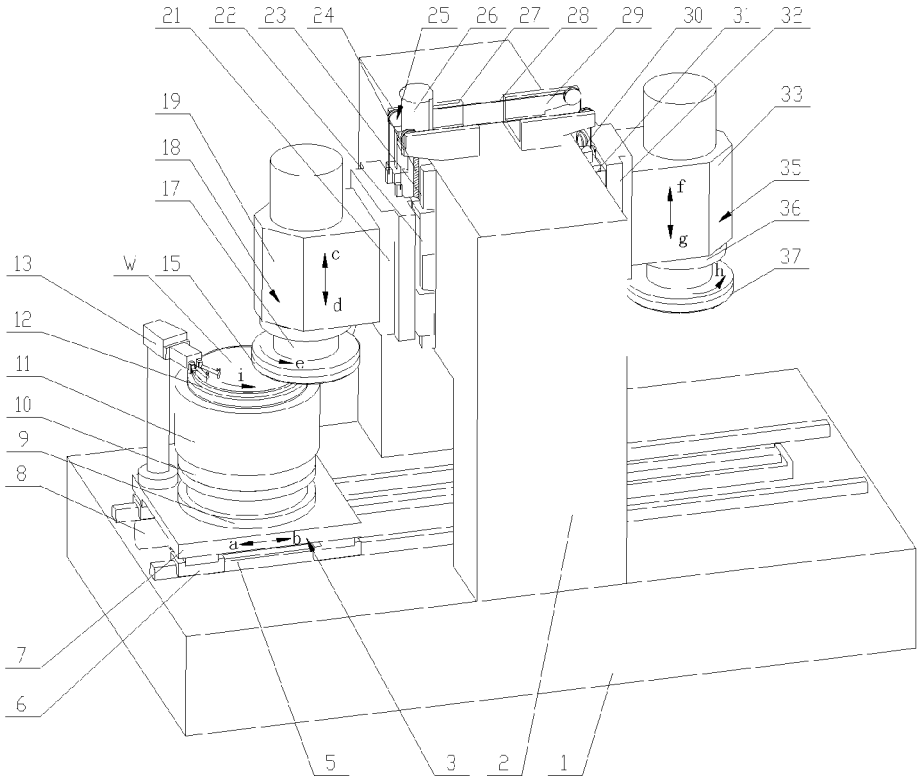
FIG. 1. illustrates a grinding and polishing machine according to an embodiment of the invention.

The technical solution adopted by the invention is a multifunction substrate grinding and polishing device and its method, the grinding and polishing of substrate are processed in three ways.

1) When processing round sheet substrate with the method of axial plunge grinding and polishing, the substrate W to be processed is placed on the chuck 12, the table 3 driven by the feed mechanism 8 moves to the grinding spindle unit 18 below in the horizontal direction arrow b, the circle center of the substrate sheet W is fixed at the outer edge of the grinding wheel 15, maintain the table position 3 fixed in the horizontal direction.

2) When processing side sheet substrate with the method of radial plunge grinding and polishing, the grinding wheel 15 rotation direction of the spindle unit 18 is e. Meanwhile, the grinding spindle unit 18 with the motor 26 forward rotating moves along the grinding feed direction d. Keep the grinding the grinding spindle unit 18 fixed in the feed direction.

3) When using small diameter grinding or polishing wheel, back grinding of wafer with outer rim or back polishing of wafer with outer rim is achieved with the method of back grinding and polishing of wafer with outer rim, small diameter of grinding wheel or polishing wheel diameter is slightly smaller than the radius of the substrate W to be processed which will be placed on the chuck 12.

When using the method of any one of the above grinding methods, put the substrate W to be processed on the mentioned chuck 12, the mentioned disk-shaped chuck 12 is made of porous ceramic material, the mentioned table 3 driven by the feed mechanism 8 moves in the horizontal direction a towards the bottom of the grinding spindle unit, the mentioned spindle motor 17 drives the mentioned grinding wheel 15 rotating along the direction of grinding wheel rotation, the mentioned motor 26 or cylinder 39 drives the mentioned grinding spindle unit 18 feeding upward along the grinding feed direction d, the mentioned force measuring device 10 will transmit monitored grinding force to the control system, controlling the grinding force equal to the default value. When the mentioned thickness measuring device 13 detects the substrate W reaching the preset thickness, the mentioned grinding spindle unit 18 withdraw along the grinding vertical guide rail 23 completing the grinding of the substrate W. The mentioned feed mechanism 8 drives the mentioned work table 3 moving along horizontal direction a to the bottom of the polishing spindle unit 35, described polishing spindle motor 36 drives described polishing wheel 37 along a direction of wheel rotation h, described motor 26 or cylinder 39 drives described polishing spindle unit 35 feeding upward along the polishing feed direction g, described force measuring device 10 will transmit monitored grinding force to the control system, controlling the polishing force equal to the default value, described polishing spindle unit 18 withdraw along the polishing vertical guide rail 30 after polishing, the polishing process of the substrate W is completed. Described force measuring device 10 detects grinding force in the process of grinding or polishing force in the process of polishing and transmits the detection data to the control system to ensure the grinding or polishing force equal preset force. Described work table 3 driven by described feed mechanism 8 feeds along the horizontal direction a toward the unloading area.

A multifunction substrate grinding and polishing device as in FIG. 1, characterized in double-spindle structure consisting of grinding spindle unit and polishing spindle unit, in which both substrate grinding and polishing can be done. Substrate grinding and polishing device has a rectangular shaped base 1, on which a pair of horizontal guides 5 is fixed. Slides are mounted on the horizontal guides 5. Slide table 7 is placed under the working table 3 and is fixed with slides 6, i.e. the working table 3 is fitted on a pair of horizontal guides through slides and slide table. The base 9 is installed on the work table 3. The force measurement 10 with round shape used for online force measuring is mounted on the upper surface of the base 9. Thickness measurement device 13 is mounted on a work table 3. The work-piece spindle motor 11 installed in the center of the work table 3 is put inside the force measuring device 10. The chuck 12 is installed on the top of work-piece spindle motor 11. The feed mechanism 8 is connected with the working table 3.

The column 2 is mounted on the middle of the base 1. A pair of grinding vertical guides 23 is mounted on the front side of the column 2. The grinding spindle unit 18 moving along the vertical feeding direction c or d is mounted on grinding vertical guides 23. A pair of polishing vertical guides 30 is mounted on the back side of the column 2. The polishing spindle unit 35 moving along the vertical feeding direction for g is mounted on polishing vertical guides 30.

Grinding spindle unit 18 and polishing spindle unit 35 connect to each other by a suspension mechanism 25, which is fixed to the front support base 27 and back support base 29 on the top of the column through traction rope.

A substrate grinding and polishing device as claimed, characterized in that the described grinding spindle unit 18 having a spindle base 19. The grinding motor spindle 17 is installed inside the grinding spindle base 19. The grinding wheel 15 rotating along direction e is installed at the bottom of grinding motor spindle 17. Spindle base 19 is mounted on the slide plate 21. Sliders 22 are mounted on the slide plate 21. The slide plate 21 move along a pair of grinding vertical guides 23 via sliders 22. The screw mechanism 24 fixed to the back of slide plate 21 is connected to the motor 26 at the top, described grinding motor spindle 17 drives the wheel 15 rotate along the direction of wheel rotation e. Described motor 26 could drive the grinding spindle unit 18 carry out lifting movement along grinding feed direction c or d, it could also drive the polishing spindle unit 35 carrying out lifting movement along polishing feed direction f or g to in order to achieve fixed stroke grinding.

Figure 3:
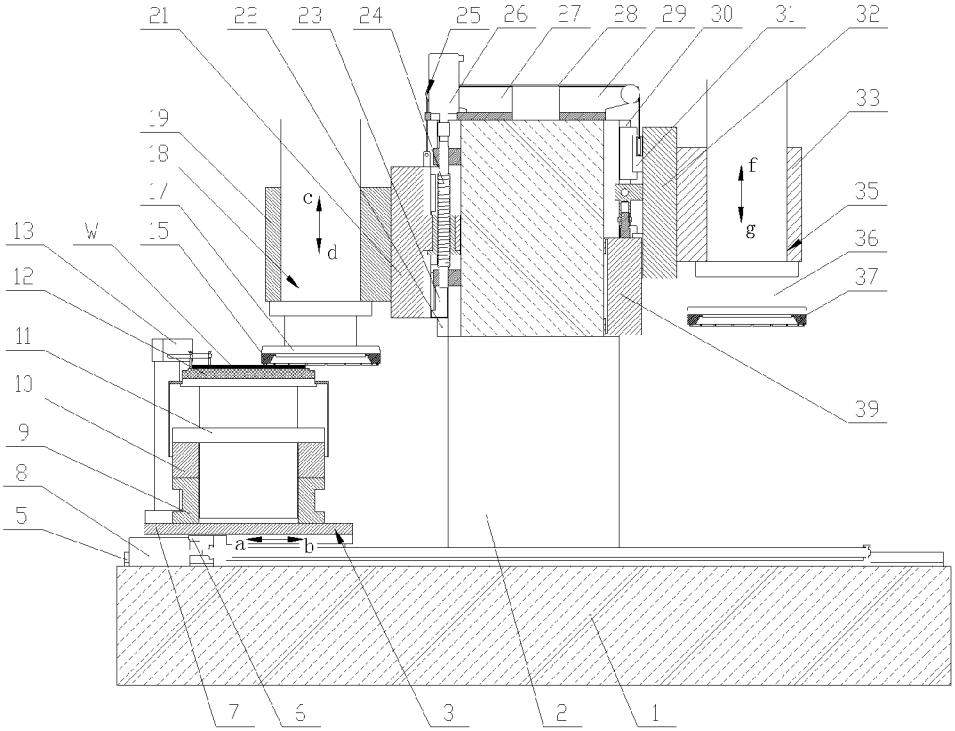
FIG. 3. illustrates a cross-sectional view of a grinding and polishing machine according to an embodiment of the invention.

As in FIG. 3, there is a spindle base 33 in the polishing spindle unit 35. The polishing motor spindle 36 is installed inside the spindle base 33. The polishing wheel 37 rotating along direction h is installed at the bottom of grinding motor spindle 17. Spindle base 33 is mounted on the slide plate 32. Sliders 31 are mounted on the slide plate 32. The slide plate 21 move along a pair of polishing vertical guides 30 via sliders 31. The polishing spindle unit 35 moves along polishing feed direction f or g as in FIG. 4. The cylinder 39 is mounted at the lower end of vertical guide polishing 30 in parallel. The cylinder 39 drives the polishing spindle unit 35 to carry out lifting movement along polishing feed direction f or g. Under the traction of the traction rope 28, the grinding spindle unit 18 moves along the feed direction c or d simultaneously as in FIG. 5 and FIG. 1.

Figure 2:
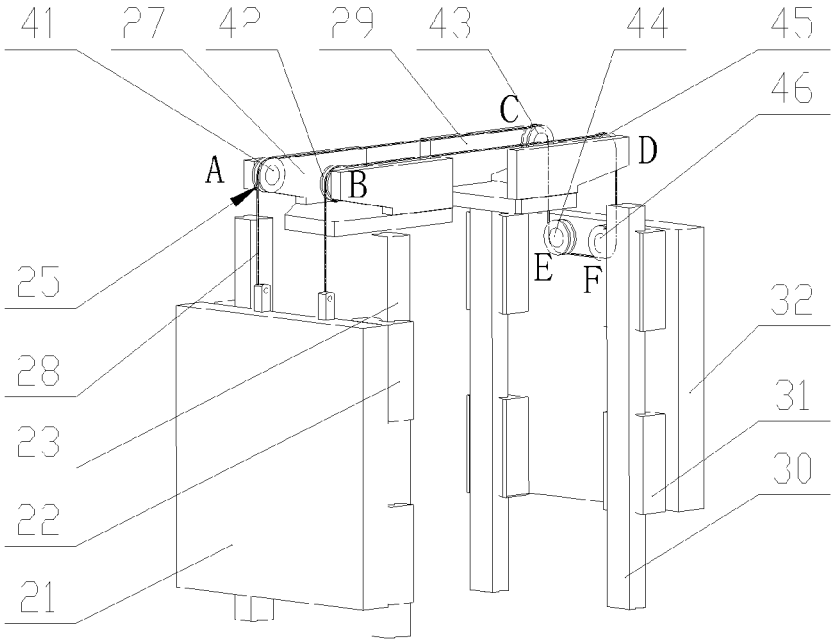
FIG. 2. illustrates a suspension mechanism structure according to an embodiment of the invention.

The described suspension mechanism 25 as in FIG. 2 is fixed to the front support base 27 and back support base 29 on the top of the column 2 through traction rope 28. Pulley A 41 and pulley B 42 are installed at the front support base 27. Pulley C 43 and pulley D 45 are installed at the back support base 29. Pulley E 44 and Pulley F 46 are installed on side of the slide plate 32. The traction rope 28, with one end fixed to upper left of the slide plate 21, bypassing pulley A 41, pulley C 43, pulley E 44, pulley F 46, pulley D 45 and pulley B 42 respectively, is finally fixed on upper right of the slide plate. Since the traction rope 28 connects the described grinding spindle unit 18 and the described polishing spindle unit 35 together, the grinding spindle unit 18 and polishing spindle unit 35 could counterweigh mutually, which could ensure the described grinding spindle unit 18 and the described polishing spindle unit 35 have the same displacement.

Figure 4:
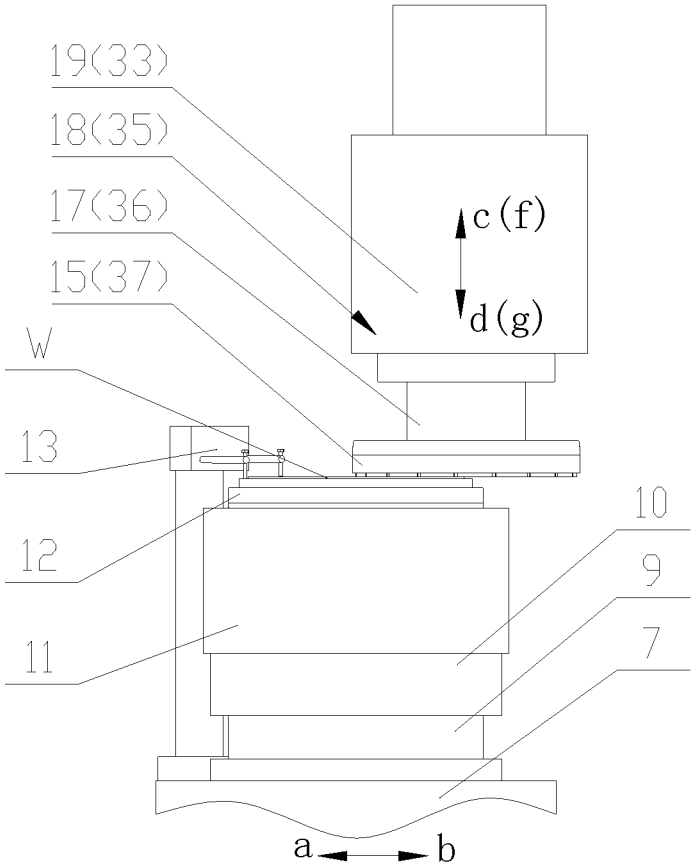
FIG. 4 illustrates a zoomed-in view of the grinding and polishing machine with various grinding and polishing motions according to an embodiment of the invention.
Figure 5:
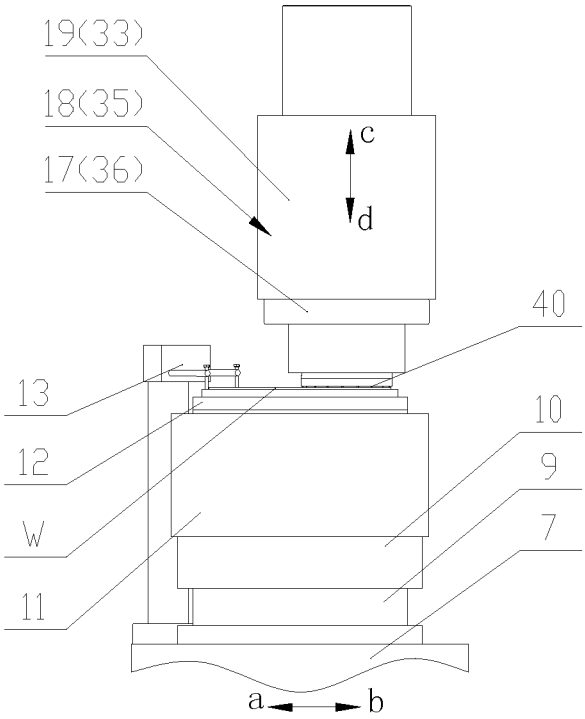
FIG. 5 illustrates a zoomed-in view of the grinding and polishing machine with various grinding and polishing motions according to an embodiment of the invention.

FIG. 1 shows the structure diagram of the invented multifunction grinding and polishing device, FIG. 2 shows the suspension mechanism structure diagram of the invented multifunction grinding and polishing device, FIG. 3 shows the cross-sectional view of the invented multifunction grinding and polishing device. FIG. 4 shows grinding and polishing methods adopted by example 1 and 2. FIG. 5 shows the grinding and polishing method adopted by example 3. In the figures: 1 base, 2 column, 3 work table, 5 horizontal guides, 6 sliders, 7 slide table, 8 feed mechanism, 9 base, 10 force measuring device, 11 workpiece motor spindle, 12 chuck, 13 thickness gauge, 15 grinding wheel, 17 grinding motor spindle, 18 grinding spindle unit, 19 spindle base, 21 slide plate, 22 sliders, 23 vertical grinding guides, 24 screw module, 25 suspension mechanism, 26 motor, 27 former support base, 28 traction rope, 29 back support base, 30 polishing vertical guides, 31 sliders, 32 slide plate, 33 spindle base, 35 polishing spindle unit, 36 polishing motor spindle, 37 polishing wheel, 39 cylinders, 40 small diameter grinding wheel or polishing wheels, 41 pulleys A, 42 pulley B, 43 pulley C, 44 pulleys E, 45 pulley D, 46 pulley F, W substrate.

The invention provides the following advantages:

(1) Double-spindle structure is used in the substrate grinding and polishing device where grinding and polishing of substrates such as silicon wafer, glass panels, ceramics and sapphire substrate can be done.

(2) After grinding, without unloading the substrate, the substrate moves from the grinding station directly into the polishing station waiting for the polishing process of a substrate.

(3) Many processing methods could be achieved in the device such as axial plunge grinding and polishing, radial plunge grinding and polishing and back grinding and polishing of wafer with outer rim.

(4) The grinding spindle unit and polishing spindle counterweigh mutually via a traction rope, sharing a motor driven feed mechanism and cylinder feed mechanism.

(5) Fixed stroke grinding and force control grinding could be realized during the grinding or polishing process of the substrate.

The specific implementation of the invention will be described in detail with technical solutions and accompanying drawings in the following. The grinding and polishing method of the invented multifunction grinding and polishing substrate device is as follows. Put the substrate W to be processed on the chuck 12, the disk-shaped chuck 12 is made by porous ceramic material, the table 3 driven by the feed mechanism 8 moves along the horizontal direction a towards the bottom of the grinding spindle unit, the spindle motor 17 drives the grinding wheel 15 rotating along the direction of grinding wheel rotation, the motor 26 or cylinder 39 drives the grinding spindle unit 18 feeding upward along the grinding feed direction d, the force measuring device 10 will transmit monitored grinding force to the control system, controlling the grinding force equal to the default value, when the thickness measuring device 13 detects the substrate W reaching the preset thickness, the grinding spindle unit 18 withdraws along the grinding vertical guide rail 23 completing the grinding of the substrate W. The feed mechanism 8 drives the work table 3 moving along horizontal direction a to the bottom of the polishing spindle unit 35, polishing spindle motor 36 drives polishing wheel 37 rotating along wheel rotation direction h, motor 26 or cylinder 39 drives polishing spindle unit 35 feeding upward along the polishing feed direction g, force measuring device 10 will transmit monitored grinding force to the control system, controlling the polishing force equal to the default value, polishing spindle unit 18 withdraws along the polishing vertical guide rail 30 after polishing, the polishing process of the substrate W is completed. The force measuring device 10 detects grinding force in the process of grinding or polishing force in the process of polishing and transmits the detection data to the control system to ensure the grinding or polishing force equal preset force. The work table 3 driven by the feed mechanism 8 feeds along the horizontal direction a toward the unloading area, as is shown in FIG. 1.

There is a rectangular shaped base 1 in the multifunction substrate grinding and polishing device, on which a pair of horizontal guides 5 is fixed. The work table 3 carrying the substrate W is mounted on the horizontal guides 5 and it could move along direction a or b. The column 2 is mounted on the middle of the base 1. A pair of grinding vertical guides 23 is mounted on the front side of the column 2. The grinding spindle unit 18 moving along the vertical feeding direction c or d is mounted on grinding vertical guides 23. A pair of polishing vertical guides 30 is mounted on the back side of the column 2. The polishing spindle unit 35 moving along the vertical feeding direction for g is mounted on polishing vertical guides 30, as is shown in FIG. 2. Grinding spindle unit 18 and polishing spindle unit 35 connect to each other by a suspension mechanism 25, which is fixed to the front support base 27 and back support base 29 on the top of the column. Pulley A 41 and pulley B 42 are mounted on the front support base 27. Pulley C 43 and pulleys D 45 are mounted on the back support base 29. Pulley E 44, pulley F 46 mounted on the side of slide plate 32. The traction rope 28, with one end fixed to upper left of the slide plate 21, bypassing pulley A 41, pulley C 43, pulley E 44, pulley F 46, pulley D 45 and pulley B 42 respectively, is finally fixed on upper right of the slide plate 21. Using one traction rope 28 can ensure the slide plate 21 and the slide plate 32 subject to the same traction on both sides, so as not to increase the overturning moment. Of course, the above roping is just one aspect, the present invention is not limited to this method. For example, slide plate 21 and the slide plate 32 are interchangeable.

Considering FIG. 1 and FIG. 3, the work table 3 moves along horizontal direction driven by feed mechanism 8, which could be considered as linear module, linear motor or servo motor and ball screw mechanism. Direction a is define as forward while direction b backward. There is a base 9 in the work table 3. The force measurement 10 with round shape used for online force measuring is mounted on the upper surface of the base 9. The force measurement 10 could measure grinding force in grinding process and polishing force in polishing process and transmit these data to the control system to ensure the grinding force or polishing equal to the default value. The work-piece spindle motor 11 installed in the center of the work table 3 is put inside the force measuring device 10. The chuck 12 is installed on the top of work-piece spindle motor 11. Put the substrate W to be processed on the chuck 12. The chuck 12 rotates along direction I driven by the work-piece spindle motor 11. In the grinding and polishing process described above, the substrate W is processed to the preset thickness. Thickness measuring device 13 measures the height of substrate W on the chuck 12 and transmits this data to the control system. When the thickness reaches the default value, the process is finished.

A multifunction method of grinding and polishing a substrate, characterized in that the method of grinding and polishing a substrate in three ways:

1) When processing round sheet substrate with the method of axial plunge grinding and polishing, the substrate W to be processed is placed on the chuck (12), the work table (3) driven by the feed mechanism (8) moves to the grinding spindle unit (18) below in the horizontal direction arrow (b), the circle center of the substrate sheet (W) is fixed at the outer edge of the grinding wheel (15), maintain the position of work table (3) fixed in the horizontal direction.

2) When processing side sheet substrate with the method of radial plunge grinding and polishing, the grinding wheel (15) rotation direction of the spindle unit (18) is (e); Meanwhile, the grinding spindle unit (18) with the motor (26) forward rotating moves along the grinding feed direction (d), keep the grinding the grinding spindle unit (18) fixed in the feed direction.

3) When using small diameter grinding or polishing wheel, back grinding of wafer with outer rim or back polishing of wafer with outer rim is achieved with the method of back grinding and polishing of wafer with outer rim. Small diameter of grinding wheel or polishing wheel diameter is slightly smaller than the radius of the substrate (W) to be processed which will be placed on the chuck (12).

When using the method of any one of the above grinding method, put the substrate (W) to be processed on the described chuck (12), the described disk-shaped chuck (12) is made by porous ceramic material. The described work table (3) driven by the feed mechanism (8) move in the horizontal direction (a) towards the bottom of the grinding spindle unit. The described spindle motor (17) drives the described grinding wheel (15) rotating along the direction of grinding wheel rotation. The described motor (26) or cylinder (39) drives the described grinding spindle unit (18) feeding upward along the grinding feed direction (d). The described force measuring device (10) will transmit monitored grinding force to the control system, controlling the grinding force equal to the default value. When the described thickness measuring device (13) detects the substrate (W) reaching the preset thickness, the described grinding spindle unit (18) withdraws along the grinding vertical guide rail (23) completing the grinding of the substrate (W). The described feed mechanism (8) drives the described work table (3) moving along horizontal direction (a) to the bottom of the polishing spindle unit (35). The described polishing spindle motor (36) drives described polishing wheel (37) along a direction of wheel rotation (h), described motor (26) or cylinder (39) drives described polishing spindle unit (35) feeding upward along the polishing feed direction (g), described force measuring device (10) will transmit monitored grinding force to the control system, controlling the polishing force equal to the default value. The described polishing spindle unit (18) withdraws along the polishing vertical guide rail (30) after polishing, the polishing process of the substrate (W) is completed. Described force measuring device (10) detects grinding force in the process of grinding or polishing force in the process of polishing and transmits the detection data to the control system to ensure the grinding or polishing force equal preset force. Described work table (3) driven by described feed mechanism (8) feeds along the horizontal direction (a) toward the unloading area.

A multifunction substrate grinding and polishing device, characterized in double-spindle structure consisting of grinding spindle unit and polishing spindle unit, in which both substrate grinding and polishing can be done. Substrate grinding and polishing device has a rectangular shaped base (1), on which a pair of horizontal guides (5) is fixed. Slides are mounted on the horizontal guides (5). Slide table (7) is placed under the work table (3) and are fixed with slides (6), i.e. the work table (3) is fitted on a pair of horizontal guides through slides and slide table. The base (9) is installed on the work table (3). The force measurement (10) with round shape used for online force measuring is mounted on the upper surface of the base (9). Thickness measurement device (13) is mounted on a work table (3). The work-piece spindle motor (11) installed in the center of the work table (3) is put inside the force measuring device (10). The chuck (12) is installed on the top of work-piece spindle motor (11). The feed mechanism (8) is connected with the working table (3).

The column (2) is mounted on the middle of the base (1). A pair of grinding vertical guides (23) is mounted on the front side of the column (2). The grinding spindle unit (18) moving along the vertical feeding direction (c) or (d) is mounted on grinding vertical guides (23). A pair of polishing vertical guides (30) is mounted on the back side of the column (2). The polishing spindle unit (35) moving along the vertical feeding direction (f) or (g) is mounted on polishing vertical guides (30).

Grinding spindle unit (18) and polishing spindle unit (35) connect to each other by a suspension mechanism (25), which is fixed to the front support base (27) and back support base (29) on the top of the column through traction rope.

A substrate grinding and polishing device as claimed in claim, characterized in that the described grinding spindle unit (18) having a spindle base (19). The grinding motor spindle (17) is installed inside the grinding spindle base (19). The grinding wheel (15) rotating along direction (e) is installed at the bottom of grinding motor spindle (17). Spindle base (19) is mounted on the slide plate (21). Sliders (22) are mounted on the slide plate (21). The slide plate (21) move along a pair of grinding vertical guides (23) via sliders (22). the screw mechanism (24) fixed to the back of slide plate (21) is connected to the motor (26) at the top, described grinding motor spindle (17) drives the wheel (15) rotate along the direction of wheel rotation (e). Described motor (26) could drive the grinding spindle unit (18) carry out lifting movement along grinding feed direction (c) or (d) to, it could also drive the polishing spindle unit (35) carry out lifting movement along polishing feed direction (f) or (g) to in order to achieve fixed stroke grinding.

There is a spindle base (33) in the polishing spindle unit (35). The polishing motor spindle (36) is installed inside the spindle base (33). The polishing wheel (37) rotating along direction (h) is installed at the bottom of grinding motor spindle (17). Spindle base (33) is mounted on the slide plate (32). Sliders (31) are mounted on the slide plate (32). The slide plate (21) move along a pair of polishing vertical guides (30) via sliders (31). The polishing spindle unit (35) moves along polishing feed direction (f) or (g). The cylinder (39) is mounted at the lower end of vertical guide polishing (30) in parallel. The cylinder (39) drives the polishing spindle unit (35) to carry out lifting movement along polishing feed direction (f) or (g). under the traction of the traction rope (28), the grinding spindle unit (18) moves along the feed direction (c) or (d) simultaneously.

The described suspension mechanism (25) is fixed to the front support base (27) and back support base (29) on the top of the column (2) through traction rope (28). Pulley A (41) and pulley B (42) are installed at the front support base (27). Pulley C (43) and pulley D (45) are installed at the back support base (29). Pulley E (44) and Pulley F (46) are installed on side of the slide plate (32). The traction rope (28), with one end fixed to upper left of the slide plate (21), pulley A (41), pulley C (43), pulley E (44), pulley F (46), pulley D (45) and the pulley B (42) respectively, is finally fixed on upper right of the slide plate. Since the traction rope (28) connects the described grinding spindle unit (18) and the described polishing spindle unit (35) together, the grinding spindle unit (18) and polishing spindle unit (35) could counterweigh mutually, which could ensure the described grinding spindle unit (18) and the described polishing spindle unit (35) have the same displacement.

The invention being thus described, it will be obvious that the same may be varied in many ways. Such variations are not to be regarded as a departure from the spirit and scope of the invention, and all such modifications would be obvious to one skilled in the art are intended to be included within the scope of the following claims.

We claim:

1. A substrate processing device, comprising:

a work table disposed on a plurality of horizontal tracks, wherein the work table is slidably connected to the plurality of horizontal tracks;

a motor disposed on the work table;

a chuck disposed on top of the motor, wherein the chuck is rotatably connected to the motor;

a first spindle unit disposed above the plurality of horizontal tracks;

a second spindle unit disposed above the plurality of horizontal tracks;

a screw mechanism connected to the first spindle unit or the second spindle unit, wherein the first screw mechanism is configured to displace the first spindle unit and the second spindle unit in a vertical direction perpendicular to the plurality of horizontal tracks; and wherein the first spindle unit drives a first wheel for processing a work piece, wherein the second spindle unit drives a second wheel for processing the work piece, and wherein the chuck turns the work piece, wherein the first spindle unit and the second spindle unit are connected to each other by a pulley and rope system which suspends the first and second spindle units above the plurality of tracks, so that displacement of one spindle up or down in the vertical direction causes the other spindle unit to be displaced down or up, respectively.

2. The substrate processing device of claim 1, wherein the first spindle unit and the second spindle unit are slidably mounted to an arch disposed over the plurality of tracks.

3. The substrate processing device of claim 1, wherein the first wheel for processing a work piece is selected from the group consisting of: a polishing wheel, a grinding wheel, and a burnishing wheel.

4. The substrate processing device of claim 1, wherein the second wheel for processing a work piece is selected from the group consisting of: a polishing wheel, a grinding wheel, and a burnishing wheel.

5. The substrate processing device of claim 1, further comprising:

a force measuring device disposed on the work table which measures the force provided by the first spindle unit or the second spindle unit onto the work piece.

6. The substrate processing device of claim 1, further comprising:

a thickness measuring device disposed above the work piece which monitors the thickness of the work piece during processing.

7. The substrate processing device of claim 1, further comprising:

a motor drive mechanism connected to the screw mechanism for driving the screw.

8. The substrate processing device of claim 1, wherein the one spindle unit is driven by the screw mechanism and the other spindle unit is counterweighted.

9. The substrate processing device of claim 1, wherein the first wheel or the second wheel is operably connected to the work piece disposed on the chuck during processing.

* * * * *